US007950509B2

(12) United States Patent
Redzisz

(10) Patent No.: US 7,950,509 B2
(45) Date of Patent: May 31, 2011

(54) DUAL COMPARTMENT TOOL BAG

(75) Inventor: Andrezj M. Redzisz, Wheeling, IL (US)

(73) Assignee: Travel Caddy, Inc., Elk Grove Village, IL (US)

( * ) Notice: Subject to any disclaimer, the term of this patent is extended or adjusted under 35 U.S.C. 154(b) by 1109 days.

(21) Appl. No.: 11/559,745

(22) Filed: Nov. 14, 2006

(65) Prior Publication Data

US 2007/0137960 A1 Jun. 21, 2007

Related U.S. Application Data

(63) Continuation-in-part of application No. 10/786,814, filed on Feb. 25, 2004, now Pat. No. 7,150,345.

(60) Provisional application No. 60/450,207, filed on Feb. 25, 2003.

(51) Int. Cl.
*A45C 3/00* (2006.01)
*A45C 13/10* (2006.01)

(52) U.S. Cl. ..... 190/111; 190/126; 190/127; 190/903; 206/372; 206/373; 383/38

(58) Field of Classification Search ..... 150/128, 150/103; 190/111, 136, 903, 125, 126; 383/107, 383/38.4; 206/373, 372
See application file for complete search history.

(56) References Cited

U.S. PATENT DOCUMENTS

| | | | | | |
|---|---|---|---|---|---|
| 529,690 | A * | 11/1894 | Arkell et al. | 383/107 |
| 1,338,776 | A * | 5/1920 | Jennings | 383/38 |
| 1,865,709 | A * | 7/1932 | Slocum | 36/7.1 R |
| 1,994,827 | A * | 3/1935 | Mayer | 150/110 |
| 2,280,601 | A * | 4/1942 | Otter | 383/38 |
| 2,298,786 | A * | 10/1942 | Dubofsky et al. | 190/126 |
| 2,495,391 | A * | 1/1950 | Smith | 206/320 |
| 2,500,341 | A * | 3/1950 | Burnett | 383/40 |
| 2,577,670 | A * | 12/1951 | Adams | 190/111 |
| 2,686,581 | A * | 8/1954 | Smith | 190/126 |
| 3,330,322 | A * | 7/1967 | Frost | 150/115 |
| 3,693,868 | A * | 9/1972 | Rich | 383/40 |
| 4,090,542 | A * | 5/1978 | Hacker, Jr. | 383/29 |
| 4,299,324 | A * | 11/1981 | Dickens | 206/170 |
| 5,423,404 | A * | 6/1995 | Shaw | 190/102 |
| 5,556,205 | A * | 9/1996 | Gallie et al. | 383/24 |
| 5,791,481 | A * | 8/1998 | Thomas | 206/581 |
| 6,126,003 | A * | 10/2000 | Brouard | 206/372 |
| 6,823,992 | B2 * | 11/2004 | Redzisz | 206/373 |
| 6,945,442 | B2 * | 9/2005 | Godshaw et al. | 224/607 |
| 2002/0126920 | A1 * | 9/2002 | Mogil | 383/110 |
| 2004/0065573 | A1 * | 4/2004 | Brouard | 206/373 |
| 2005/0189388 | A1 * | 9/2005 | Godshaw et al. | 224/607 |

* cited by examiner

*Primary Examiner* — Sue A Weaver
(74) *Attorney, Agent, or Firm* — Fitch Even Tabin & Flannery

(57) ABSTRACT

A dual compartment, dual open mouth tool bag is fabricated from flexible material forming the side and top panels of the bag and the dual access openings. Each of the separate open mouth openings provides separate access to an individual compartment within the bag. The compartments may, in an alternative embodiment, be connected one to the other or may be separated by an intermediate open top storage compartment.

9 Claims, 14 Drawing Sheets

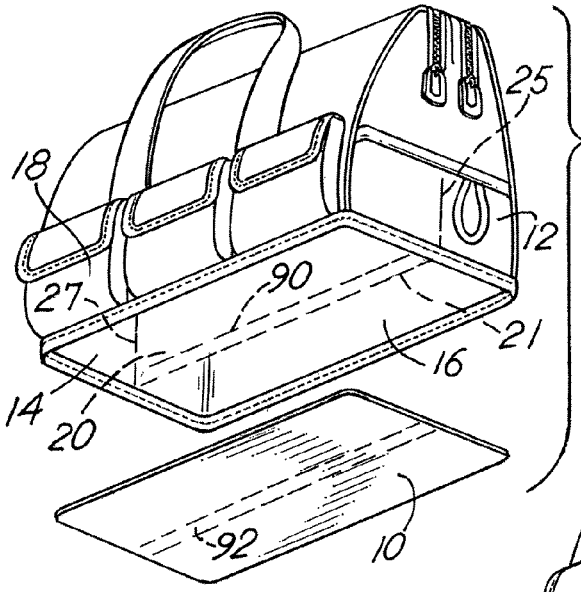
FIG.4
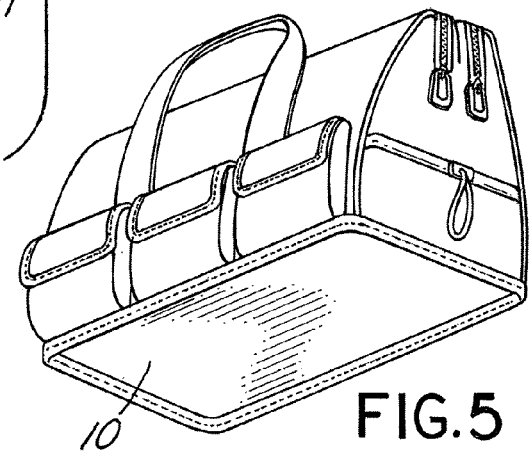
FIG.5
FIG.6
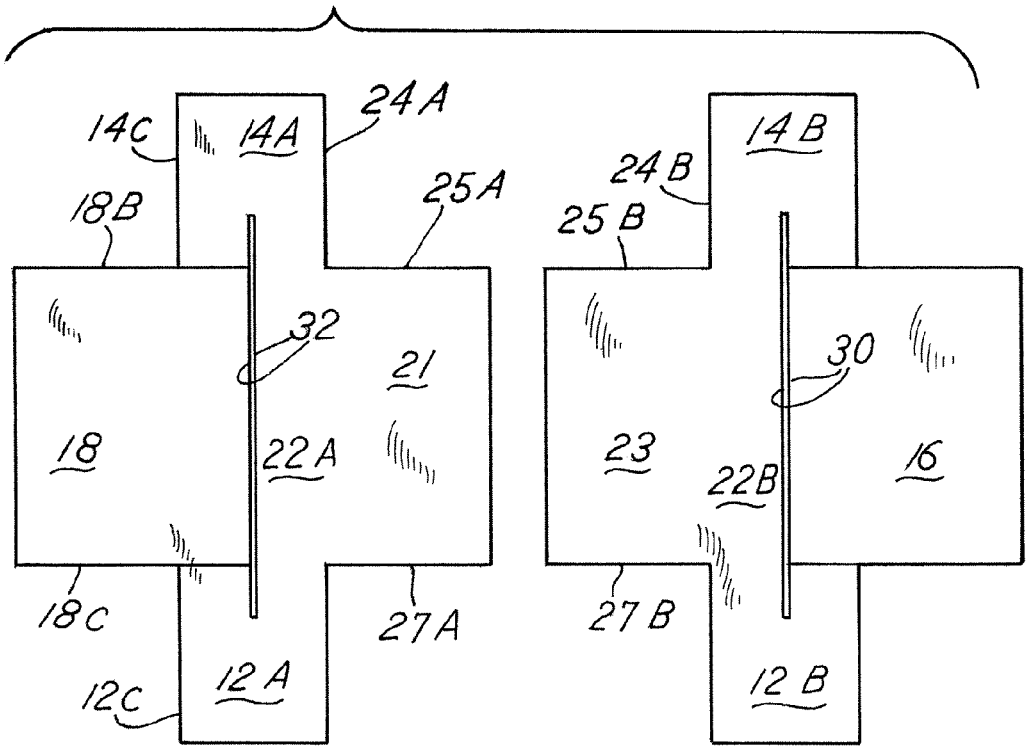

FIG.13
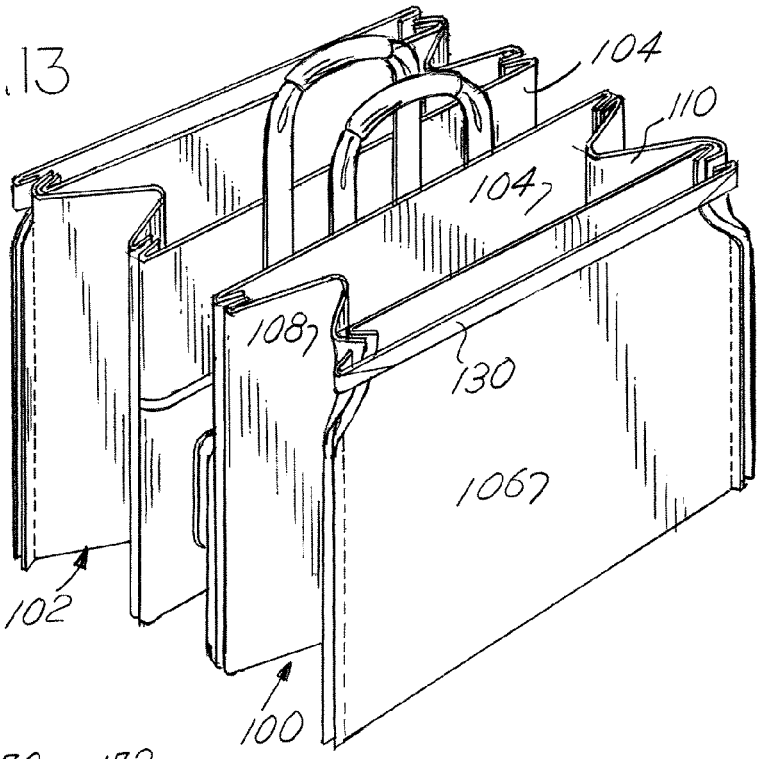
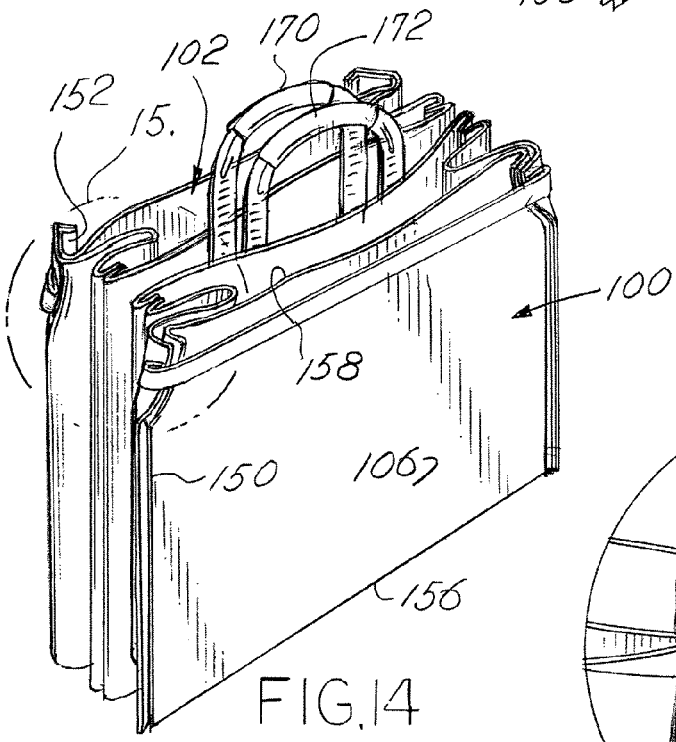
FIG.14
FIG.15
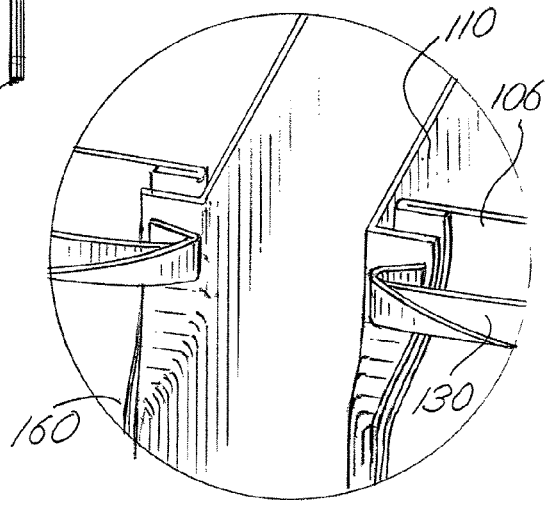

DUAL COMPARTMENT TOOL BAG

CROSS REFERENCE TO RELATED APPLICATIONS

This is a continuation-in-part of Ser. No. 10/786,814 filed Feb. 25, 2004 entitled "Dual Compartment Tool Bag", now U.S. Pat. No. 7,150,345, issued on Dec. 19, 2006, which is based upon and incorporates by reference an earlier filed provisional application Ser. No. 60/450,207 filed Feb. 25, 2003 entitled "Dual Compartment Tool Bag" for which priority is claimed to the extend permitted by law.

BACKGROUND OF THE INVENTION

In the principal aspect the present invention relates to a tool bag and, more particularly, to a tool bag, which includes first and second generally parallel access openings in the top thereof.

Historically, tool bags have been limited to a single hinge top opening for access to a single interior compartment. The hinge opening, sometimes termed a "Gatemouth" opening, provides wide-open access to the contents of the bag. This style of bag construction has also been used for travel bags, medical bags, tool bags, legal and accounting document bags and handbags.

While such single mouth or single top entry bags are exceedingly useful, often their utility is diminished since the person using such a bag may not need or desire to place all of their tools or items in a single compartment. Rather, it may be more convenient to have side-by-side, separated dual compartments. Thus, there has need for a dual compartment case or bag and, in particular, a bag having top openings which open widely by folding outwardly to reveal the entire interior of the separate compartments of the bag.

SUMMARY OF THE INVENTION

Briefly, the invention relates to a soft sided bag having first and second generally parallel flexible open mouth access openings in the top of the bag wherein each of the separate openings connect to a separate compartment within the bag and, in one embodiment, wherein the separate compartments may be joined to expose the entire undivided interior of the bag. Further, the invention contemplates the patterns of the materials utilized to create the double, open mouth bag since the configuration of various panels forming the bag is disclosed as well as the manner in which the panels are connected either permanently or temporarily by fasteners, for example, and by various sewing and assembly techniques. The bag has a generally rectangular rigid base whereas the sides of the bag are generally flexible and soft sided so that the dual open mouth construction of the bag is facilitated by the folding of the side panels and the joining thereof by a fastener mechanism such as a zipper or snap fasteners.

Thus, it is an object of the invention to provide an improved dual, open mouth bag construction which may be utilized as a tool bag, for example, wherein first and second adjacent compartments are provided within the bag, each compartment being accessible through its own individual, flexible, open mouth construction.

Yet another object of the invention is to provide an inexpensive, yet rugged and durable open mouth bag construction.

Another object of the invention is to provide patterns for dual open mouth bag constructions wherein the pattern may be utilized to provide for a bag having permanently separated dual compartments or dual compartments which may be integrated one with the other in an easy and efficient manner.

These and other objects, advantages and features of the invention will be set forth in the detailed description which follows.

BRIEF DESCRIPTION OF THE DRAWING

In the detailed description, which follows, reference will be made to the drawing comprised of the following figures:

FIG. 4 is an exploded isometric view of the component parts forming the bag or case of the invention;

FIG. 5 is an isometric view of the bag of FIG. 4 in the assembled condition;

FIG. 6 is a pattern for the flexible fabric material forming the side and internal panels of the bag;

FIG. 13 is an isometric view of the dual compartments of FIG. 12 illustrating the further steps in the making of the bag construction;

FIG. 14 is an isometric view illustrating the further steps in the manufacture of the bag which comprises the embodiment of FIGS. 7-13;

FIG. 15 is an enlarged isometric view of the stitching associated with the assembly of the bag as depicted in FIG. 14 and illustrates further steps in the manufacture thereof;

DETAILED DESCRIPTION OF THE EMBODIMENTS OF THE INVENTION

Figure 1:
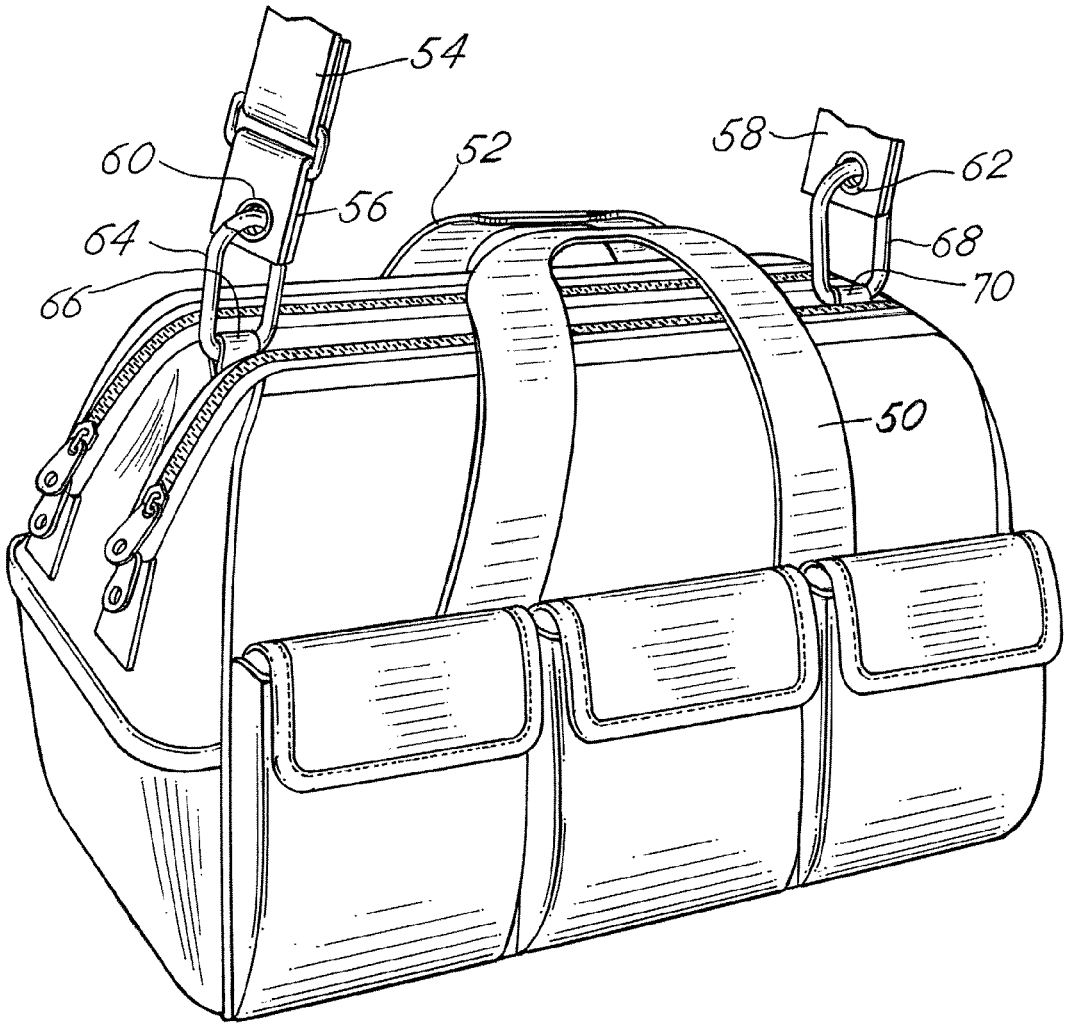
FIG. 1 is an isometric side view of a bag or case of the invention.
Figure 2:
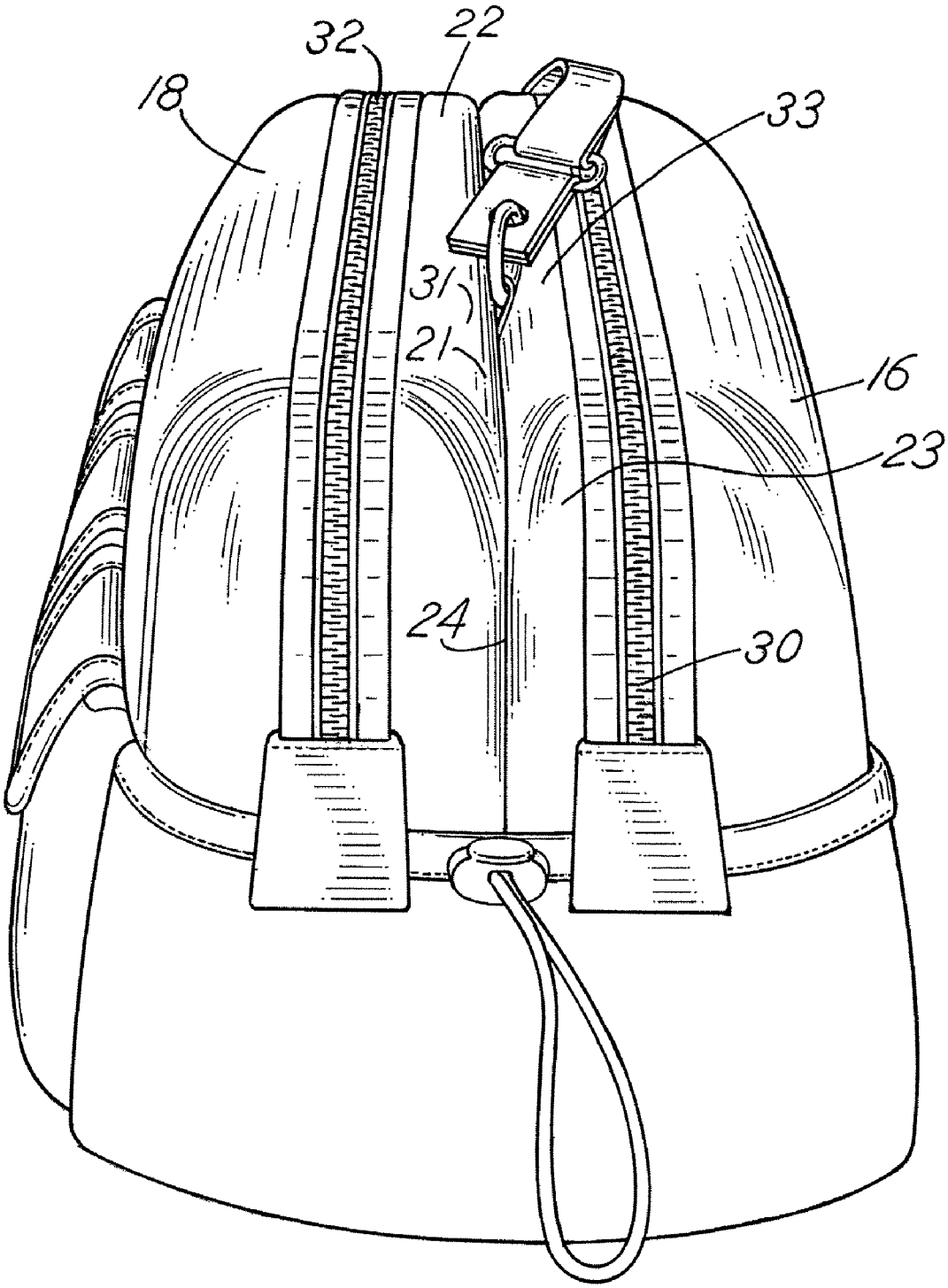
FIG. 2 is an isometric end view of the bag of FIG. 1.

The dual opening, two-compartment bag of the present invention has a multiplicity of potential uses. It may be used, for example, as a tool bag, a travel bag, a medical bag or a handbag. The design of the bag thus facilitates multiple potential uses.

Referring to the figures, the bag is a generally soft sided bag having a rigid planar flat bottom panel 10 as depicted in FIG. 4. The bag further includes first and second parallel opposite, spaced, end sides 12 and 14 and third and fourth parallel, opposite spaced lateral sides 16 and 18. The first, second, third and fourth sides are 12, 14, 16 and 18 are typically soft sided although each may be partially re-enforced or made from a rigid or semi rigid material in their lower half joined to the bottom panel 10. The sides 12, 14, 16 and 18, as well as a mid-panel 20 referenced hereinafter, are all fabricated or sewn together from a canvas material or similar material prior to attachment to the generally rectangular, flat planar, bottom panel or side 10. Thus, as shown in FIG. 4 all of the component side parts of the bag are prefabricated separate and apart from the bottom panel 10. The bottom panel 10 is then sewn or attached to the sides 12, 14, 16 and 18 to form the bag as depicted in FIG. 5.

A feature of the invention is a dual layer, mid-panel, which is depicted in phantom as mid-panel 20 in FIG. 4. Mid-panel 20 is comprised of two layers or panels 21 and 23 of flexible fabric or material which respectively are opposed to one of the lateral side panels 16 and 18. The mid-panel layers 21 and 23 are sewn or attached together along seams which join lateral end edges 25 and 27. The mid-panel layers 21 and 23 which form the mid panel 20 join to end walls 12 and 14 and define a bridge or connecting sections 22A and 22B respectively therebetween. Thus, each mid-panel layer 21 and 23 provides a flexible flap sector 31 and 33 opposed respectively to the flexible top sector of lateral sides 18 and 16.

In practice, the pattern forming for the end panels 12 and 14 and side panels 16, 18, as well as mid panel 20 (i.e. layers 21, 23) is depicted in FIG. 6 wherein seam line 24 is indicated by edges 24A, 25A, 25B and 24B associated respectively with panel parts 14A, 22B and 14B. Side panel 18 is then sewn to panel sections 12A, 14A along seam line edges 12C/18C and 14B/18B. The mid panel 20 may be a separate panel piece or integral with sides 12 and 14 as depicted in FIG. 6.

Figure 3:
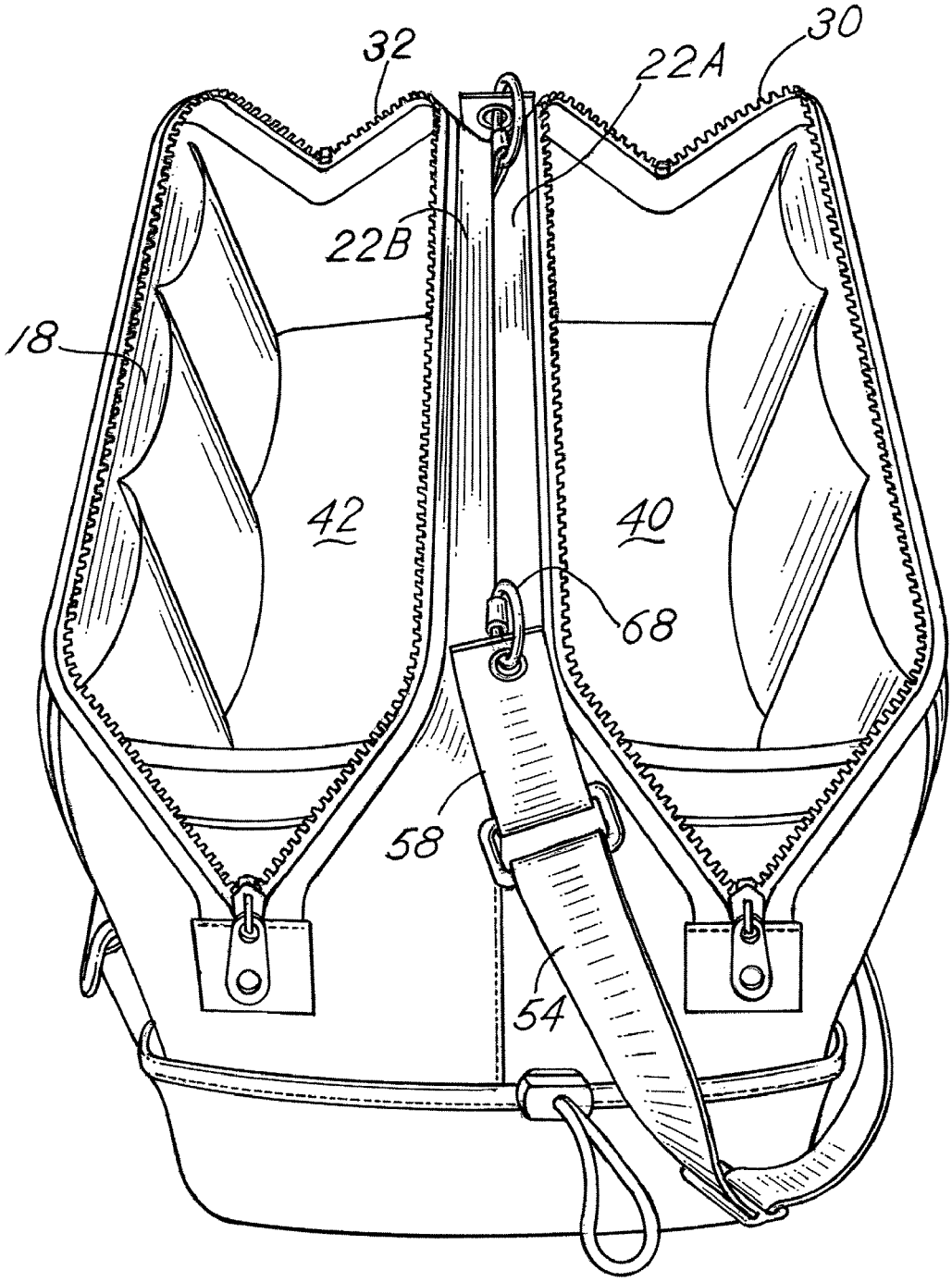
FIG. 3 is an isometric end view similar to FIG. 2 wherein, the two compartment openings for the bag are in the open position.
Figure 7:
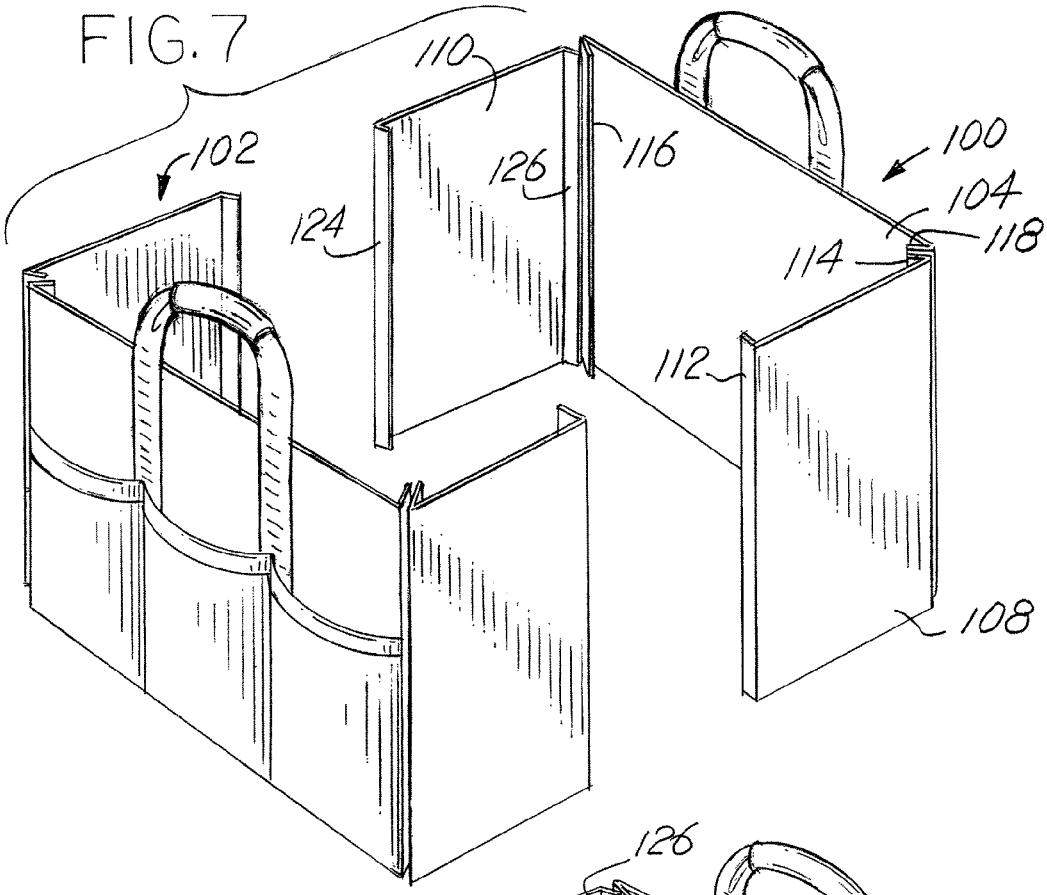
FIG. 7 is an isometric view of component parts of a second embodiment of the invention and more specifically of outside panels and end panels of a second embodiment of a dual open mouth bag construction.

Thus, connecting segment 22 (22A, 22B) joins the mid section of the first and third wall 12 and 14 and further includes a center seam 24 (24A, 24B) which is sewn or connected to the mid-panel 20 (i.e. layers 21, 23). The sidewalls 16 and 18 flexible side walls and are connected to the connecting segment 22A or 22C by means of zipper construction 30 and 32 respectively. As will be noted in FIG. 3 and FIG. 6 the connecting segment 22 comprises an extension of the first and third sidewalls 12 and 14. The zipper connection 30 joins the flexible sidewalls 16 and first and third end walls 12 and 14 with the connecting segment 22 to enclose a first compartment 40. In a similar manner, the zipper 32 joins the connecting section 22 with the first and third end walls 12 and 14 and the fourth sidewall 18 to form a compartment 42. The compartments 40 and 42 are separated one from the other by means of the mid-panel 20 (layers 21, 23) as depicted in FIG. 4.

The mid-panel 20 may be connectable to the bottom panel 10 and the end panels 12 and 14 respectably by releasable fasteners and more particularly by a loop type fastener such as known by the trade name Velcro. In this manner, the mid-panel 20 may be disengaged to from the bottom wall panel 10, and the first and third end walls 12 and 14 to provide access to a connected set of compartments 40 and 42 defining a single compartment. Thus, the separate compartments 40 and 42 will be joined together to form a single compartment. Alternatively, the mid-panel 20 could be sewn in place as described previously to provide first and second separate compartments 40 and 42 for the bag.

Carry handle straps 50 and 52 are attached to the side panels 16 and 18. A shoulder strap 54 is provided and includes fabric and loops 56 and 58 each having eyelets 60 and 62 respectably. A carabineer 64 is provided through eyelet 60 for attachment to a fabric loop 66 sewn into the seam 24. Similarly, a carabineer 68 is provided to the eyelet 62 for engagement with a fabric loop 70 sewn in the seam 24 at the opposite end of the bag. The shoulder strap arrangement described provides significant adjustment for the strap to facilitate carrying of the bag.

Figure 23:
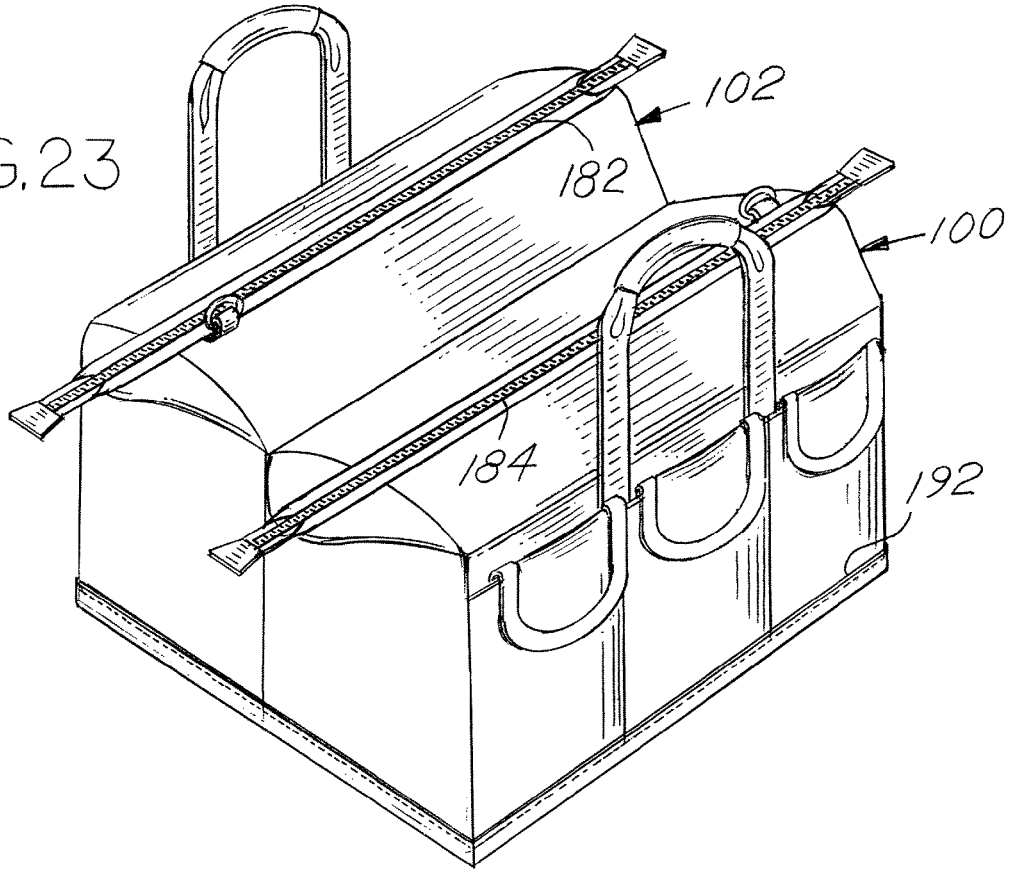
FIG. 23 is an isometric view illustrating the finished embodiment of FIGS. 7-22.
Figure 24:
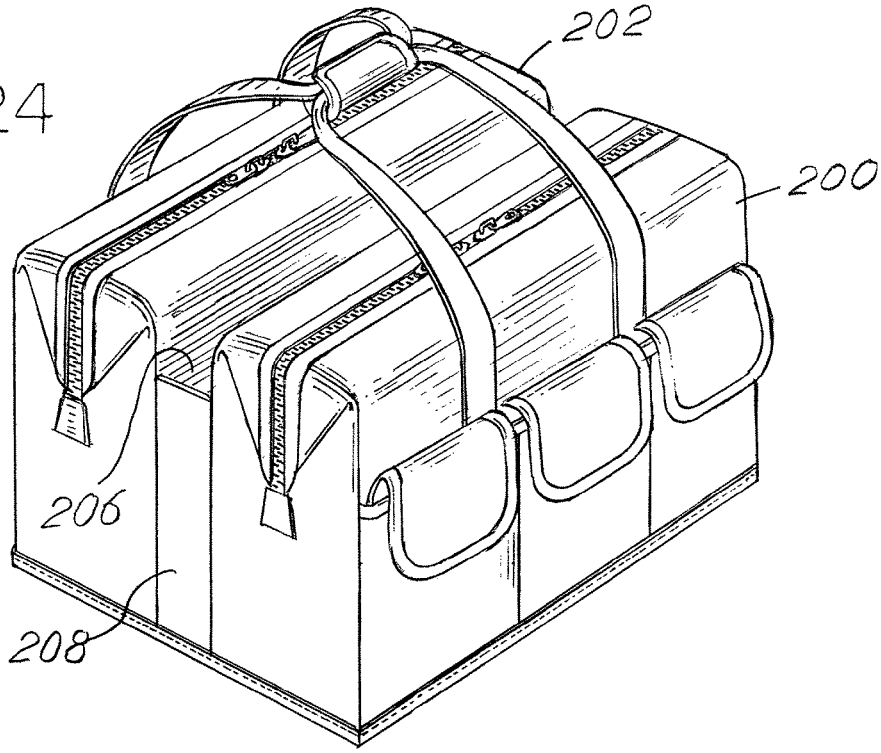
FIG. 24 is an isometric view that illustrates an alternative embodiment of the dual compartment bag construction which includes a center open top compartment and utilizes the construction techniques associated with FIGS. 17-23.
Figure 25:
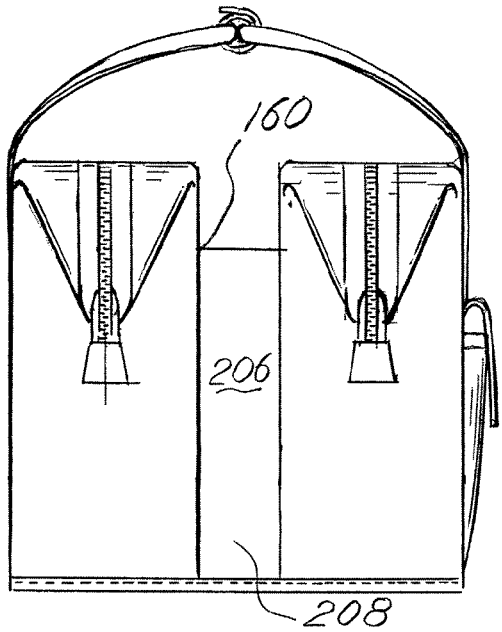
FIG. 25 is an end view of the construction or bag of FIG. 24.
Figure 26:
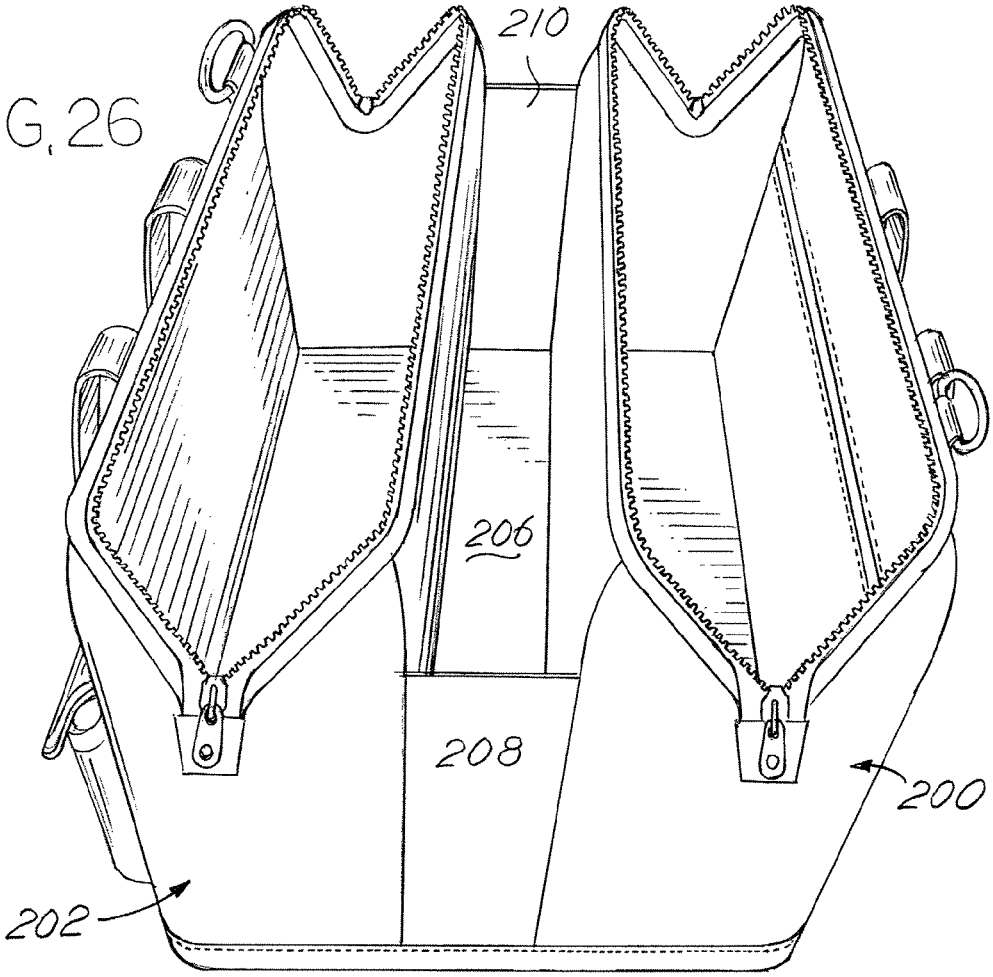
FIG. 26 is a top isometric view of the bag of FIG. 24.

FIGS. 7-23 illustrate an alternative embodiment of the invention comprised of first and second compartments that form a dual open mouth construction. FIGS. 24-26 illustrate a further embodiment of the invention wherein dual compartments forming the bag are separated by a third open top compartment. Thus, in the following description reference will be made initially to FIGS. 7-23 comprising a second embodiment. This will be followed by a discussion of a description of a third embodiment in FIGS. 24-26.

Referring therefore to the embodiment of FIGS. 7-23, the open top, dual compartment open mouth construction includes a first compartment 100 and a second compartment 102. The first compartment 100 and the second compartment 102 have substantially the same construction though having an identical construction and/or size is not necessary.

Referring to the figures, the description associated with the first compartment 100 is adopted as applicable to the second compartment 102 in general. The first compartment 100 includes an outside wall 104, an inside wall 106, a first end wall 108 and a second end wall 110. The walls 104, 106, 108 and 110 are comprised of sections of generally rectangular soft sided material, for example, a canvas, leather or some other fabric material. The inside wall 106 and outside wall 104 have generally the same dimensions. Likewise, the first end wall 108 and second end wall 110 have generally identical dimensions. The walls 104, 106, 108 and 110 are connected together by sewing techniques to form the first compartment and, in combination with a generally rigid bottom wall 190, will form a portion of the dual compartment bag construction. The combination of the first compartment 100, the second compartment 102 and a bottom wall 190 thus forms the bag construction.

Each of the walls 104, 106, 108 and 110 includes what is termed a generally vertical side margin. For example, side wall 108, which is the first side wall, includes a vertical margin 112 and a second vertical margin 114. Similarly, the front wall 104 includes margins 116, 118 along its opposite edges. The inside wall 106 also includes vertical margins at its opposite sides; namely, a margin 120 along one lateral side and a margin 122 along the opposite lateral side. Side wall 110 likewise includes margins, such as margin 124, along one side and a second margin 126 along the opposite side.

In the construction of the compartment 100, the margins 116 and 118 associated with the outside wall 104 are turned inwardly and joined to the margins 126 and 114 respectively of the second end wall 110 and first end wall 108, respectively.

Figure 8:
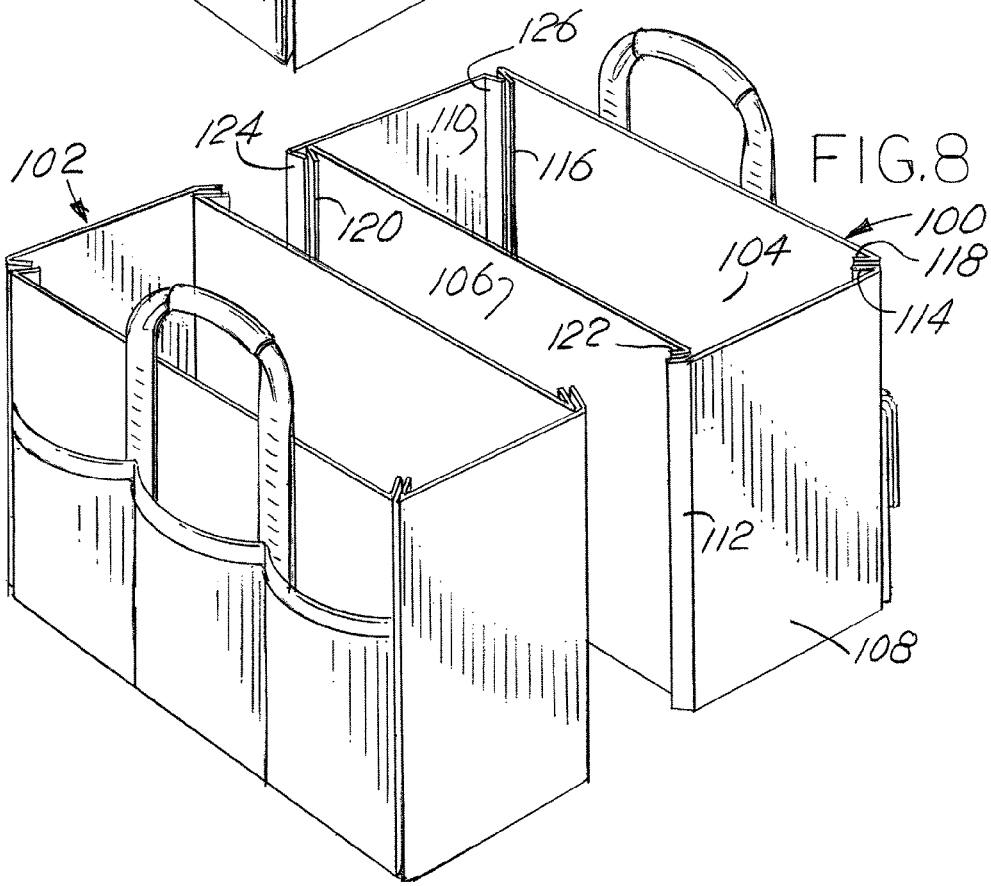
FIG. 8 is an isometric view of the embodiment of FIG. 7 illustrating the addition of inside panels associated with the two compartments of the bag construction.

The margins associated with the inside wall; namely, the margins 122 and 120 fold over the inside wall 106 as depicted in FIG. 8, for example. The first side wall 108 includes margin 112 which folds over the margin 122 of the inside wall 106. The second side wall 110 includes a margin 124 which folds over the inside wall margin 120.

Figure 9:
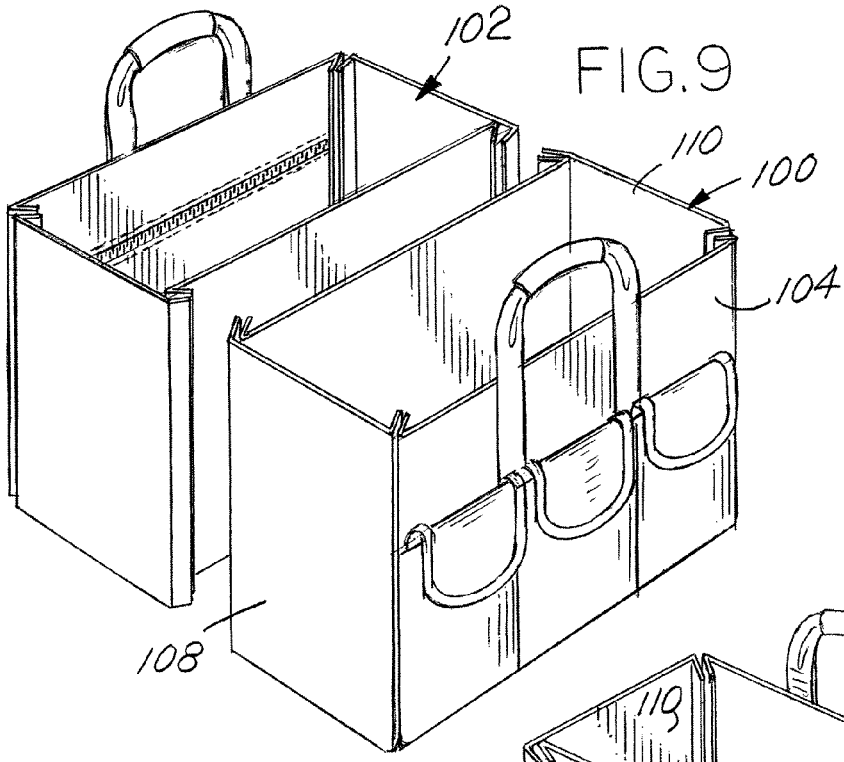
FIG. 9 is an isometric view illustrating the embodiment of FIG. 8 as viewed from the opposite side thereof.

Each of the compartments; namely, first compartment 100 and second compartment 102 are similarly constructed with margins folded in a manner described. This, for example, is illustrated in FIGS. 9 and 10.

Figure 10:
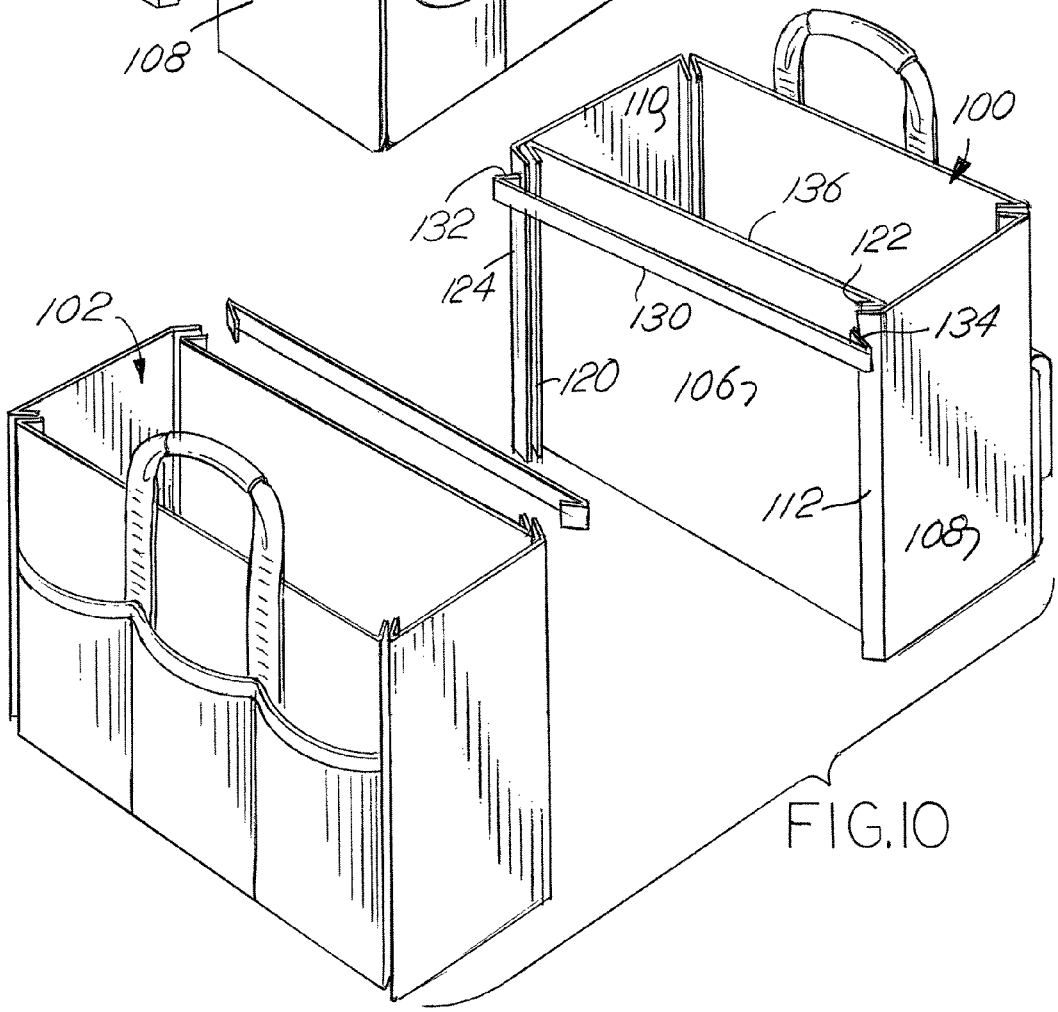
FIG. 10 is an exploded isometric view of the embodiment of FIGS. 7, 8 and 9 illustrating the manner of construction of the bag.
Figure 11:
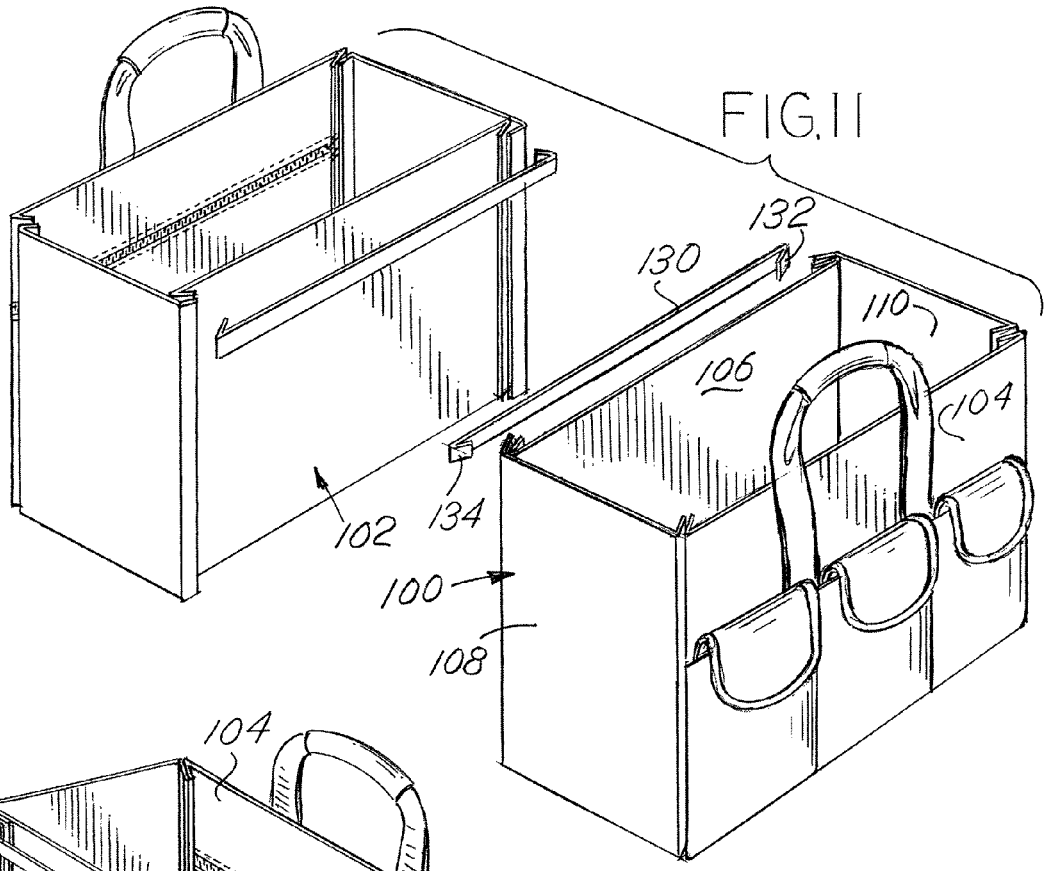
FIG. 11 is an isometric view illustrating the construction of FIG. 10 as depicted from an alternate perspective view thereof.

In one embodiment, a fabric strip, binding tape or strap 130, having opposite folded ends 132 and 134, is positioned over the margins of the inside wall and end walls 104, 106 and 110 as illustrated in FIG. 10. The strap, binding or tape 130 is positioned adjacent top edge 136 of the inside wall 106. Each of the compartments 102 and 100 includes a similar arrangement. This is further illustrated in FIG. 11 as well as in FIG. 12.

Figure 12:
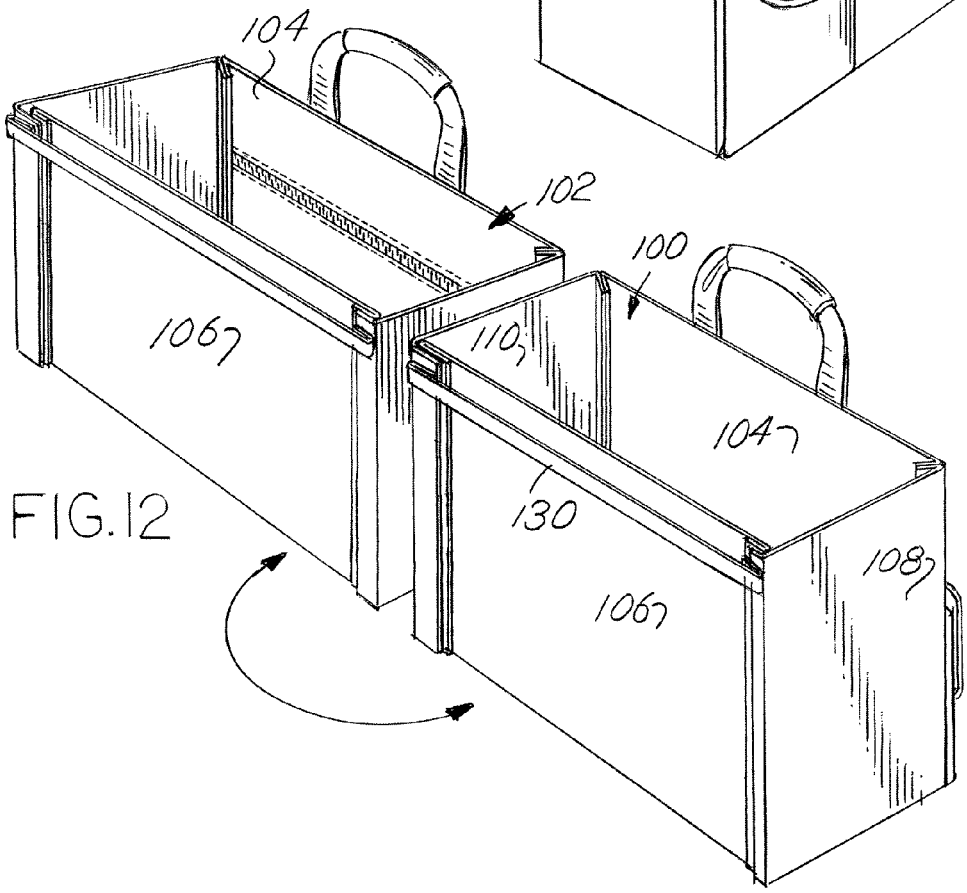
FIG. 12 is an isometric view of the separate compartments forming the dual mouth bag wherein the component compartments have been oriented for assembly.
Figure 16:
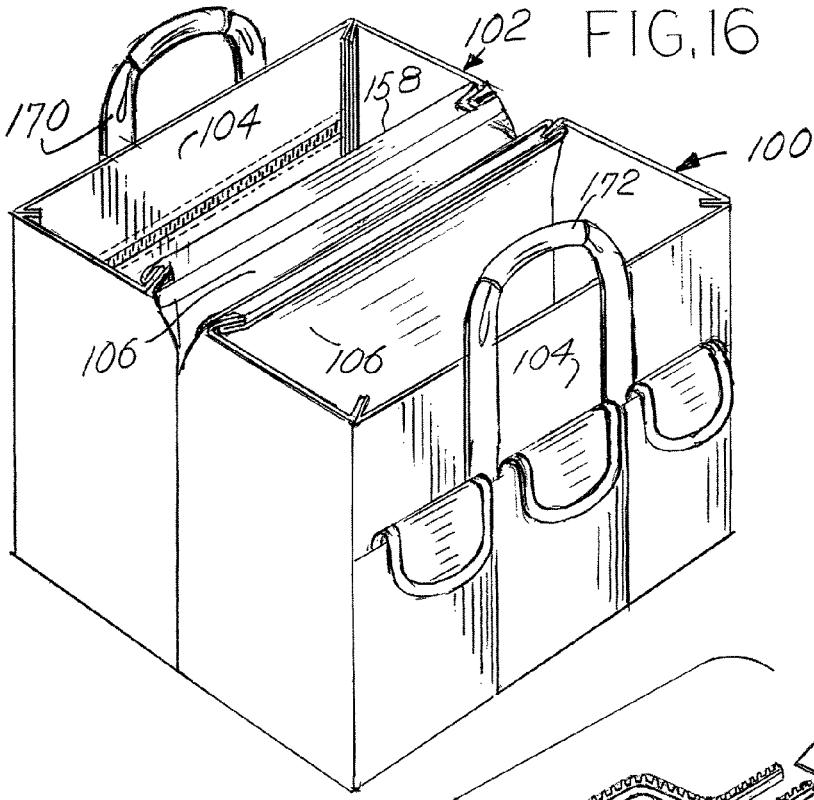
FIG. 16 is an isometric view that illustrates the construction developed as a result of the steps performed in FIGS. 14 and 15.

Next in the construction of the bag, reference is directed to FIG. 12. The separate compartments 100 and 102 are juxtaposed in opposition with respect to one another and the outside sides 104 are juxtaposed against each other as depicted, for example, in FIG. 13. Before being juxtaposed typically, the margins are sewn, or at least partially sewn, to form the separate compartments 100 and 102. That is, the margins are stitched along the portions thereof which face one another. The margins are stitched totally along the length and height of the outside faces or outside panels 104. The margins associated with the inside wall 106 are stitched as depicted. Thus the outside faces or outside sides 104 of the separate compartments are juxtaposed in opposed relationship and the inside surfaces or sides 106 face outwardly as depicted in FIG. 13. Additionally, the ends 110 and 108 are folded to permit the margins associated with the inside sides 106 to be exposed and sewn together. That is, the joined margins of the first compartment 100 associated with the inside side 106 are joined with the lateral or side margins of the second compartment 102. This is illustrated, for example, in FIG. 14. There, for purposes of illustration, the margin 150 is sewn to the margin 152 of compartment 102. In this manner, the compartments 100 and 102 are joined together along the lateral side margins of the insides sides 106.

The pattern and extent of stitching associated with the joined margins, such as margin 150, becomes an important feature of the construction associated with the double opening or dual opening bag. That is, the margin constructions 150 and 152 are stitched together only partially upwardly from a bottom edge 156 toward a top edge 158. For example, as shown in FIG. 15 the stitching proceeds upwardly to a junction 160 where the overlaying of the margins associated with the side and back face or inside face 106 and 110 and the strip 130 are sewn together and overlapped as illustrated. This enables, as will be pointed out later, the folding of the upper edge 158 of the inside surface to permit a fastener, such as a zipper, to be attached thereto to form a closure mechanism associated with the opening in the bag.

The next step in the construction is effected by turning the bag, as sewn as depicted in FIG. 14, effectively inside out. In other words, the handles 170 and 172 in FIG. 14 are juxtaposed and facing one against each other. Because the fabric or material forming the compartments is pliable, it can be folded and unfolded inside out to the condition or form, depicted for example, in FIG. 16. There, because of the sewing and stitching as described with respect to FIGS. 14 and 15, the upper edge or margin 158 of the inside walls 106 may be folded. The region below the top edge 158 of the inside walls 106; namely, the region below the junction line 160 will remain in an opposed and joined relationship of the inside walls 106 associated with both of the compartments 100 and 102. However, the upper edges of the inside walls 106 may be folded inward to partially cover the open top of the compartments 100 and/or 102. The outside face 104 of each of the compartments may likewise be folded inwardly to partially cover the open top.

Figure 17:
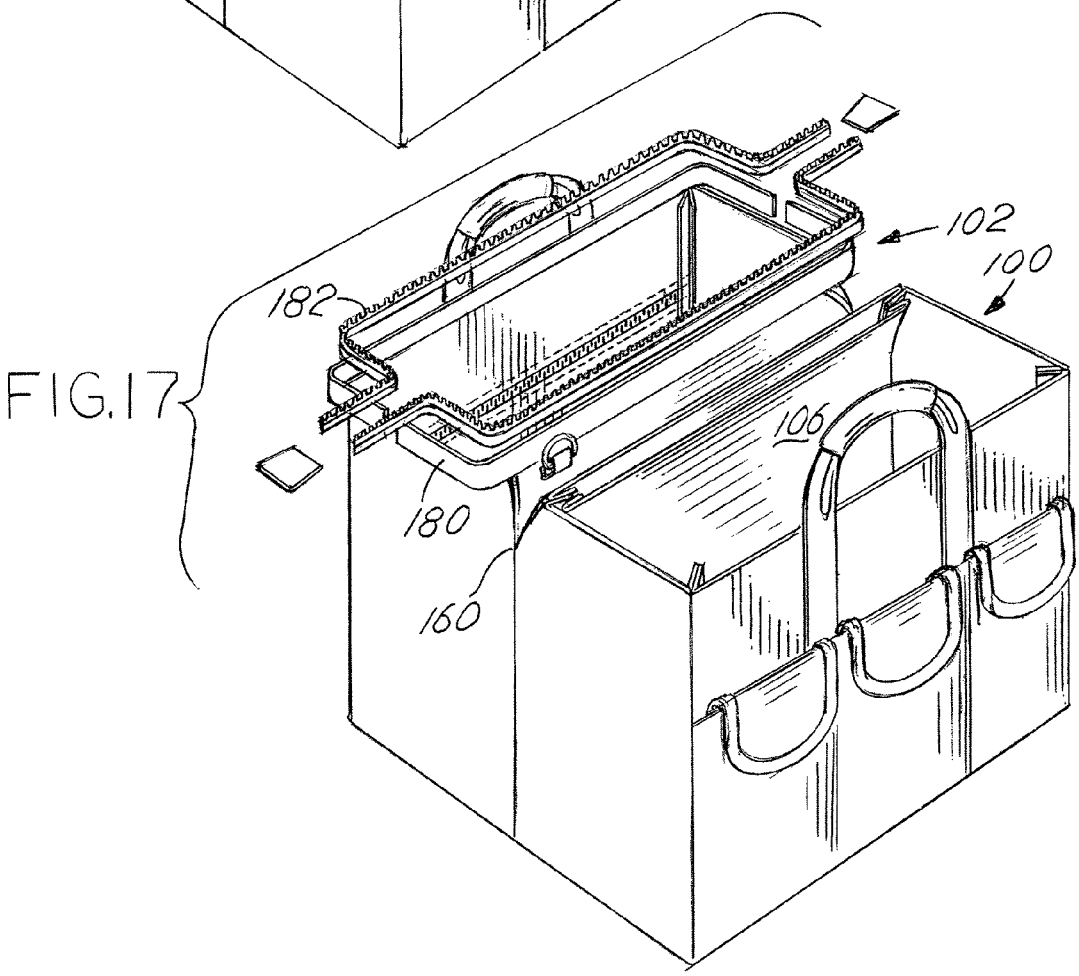
FIG. 17 is an isometric view that illustrates a further step in the construction of the embodiment of FIGS. 7-16.
Figure 18:
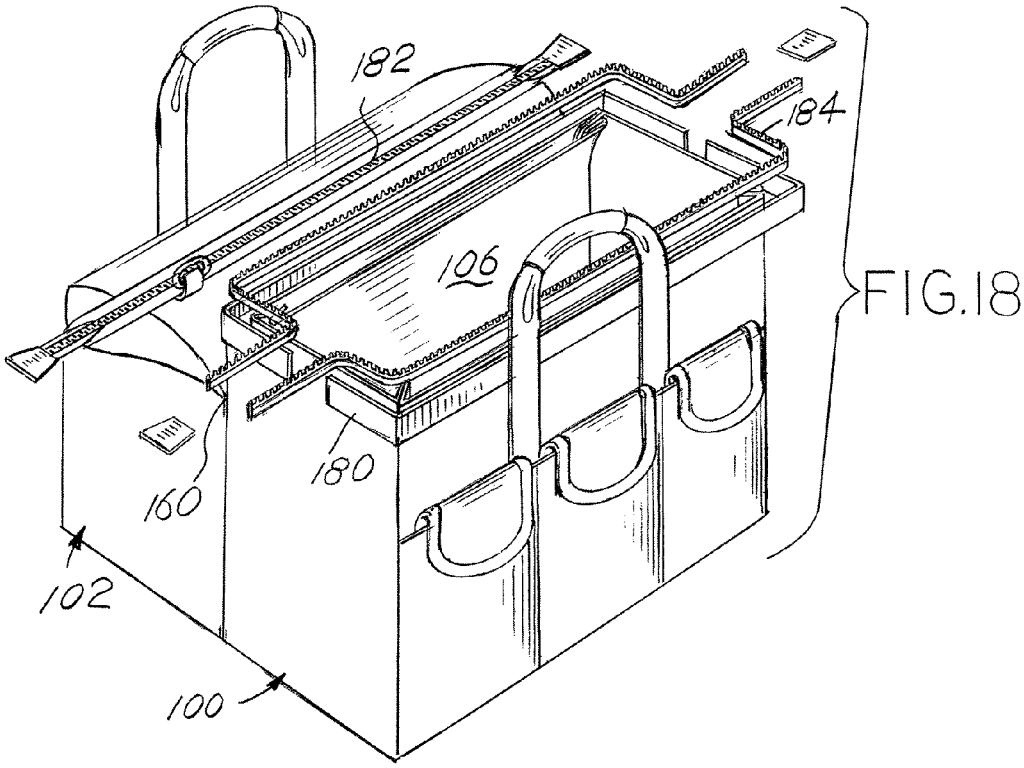
FIG. 18 is an isometric view that illustrates yet a further stage in the manufacture of the bag of FIG. 17.
Figure 19:
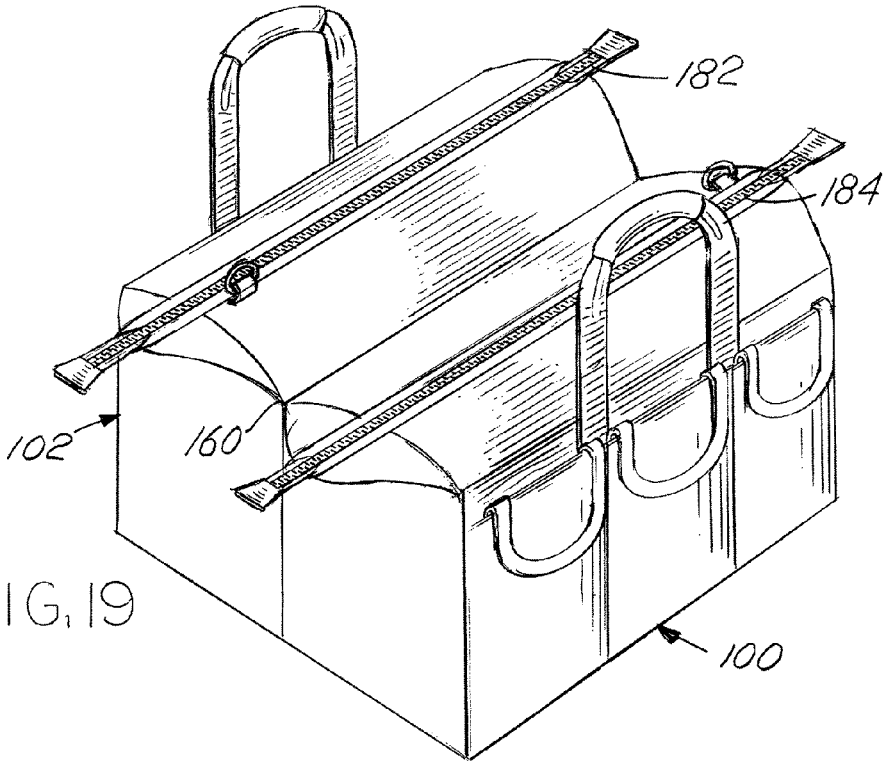
FIG. 19 is an isometric view that illustrates the fully constructed bag developed and manufactured in accord with the previously illustrated steps.
Figure 20:
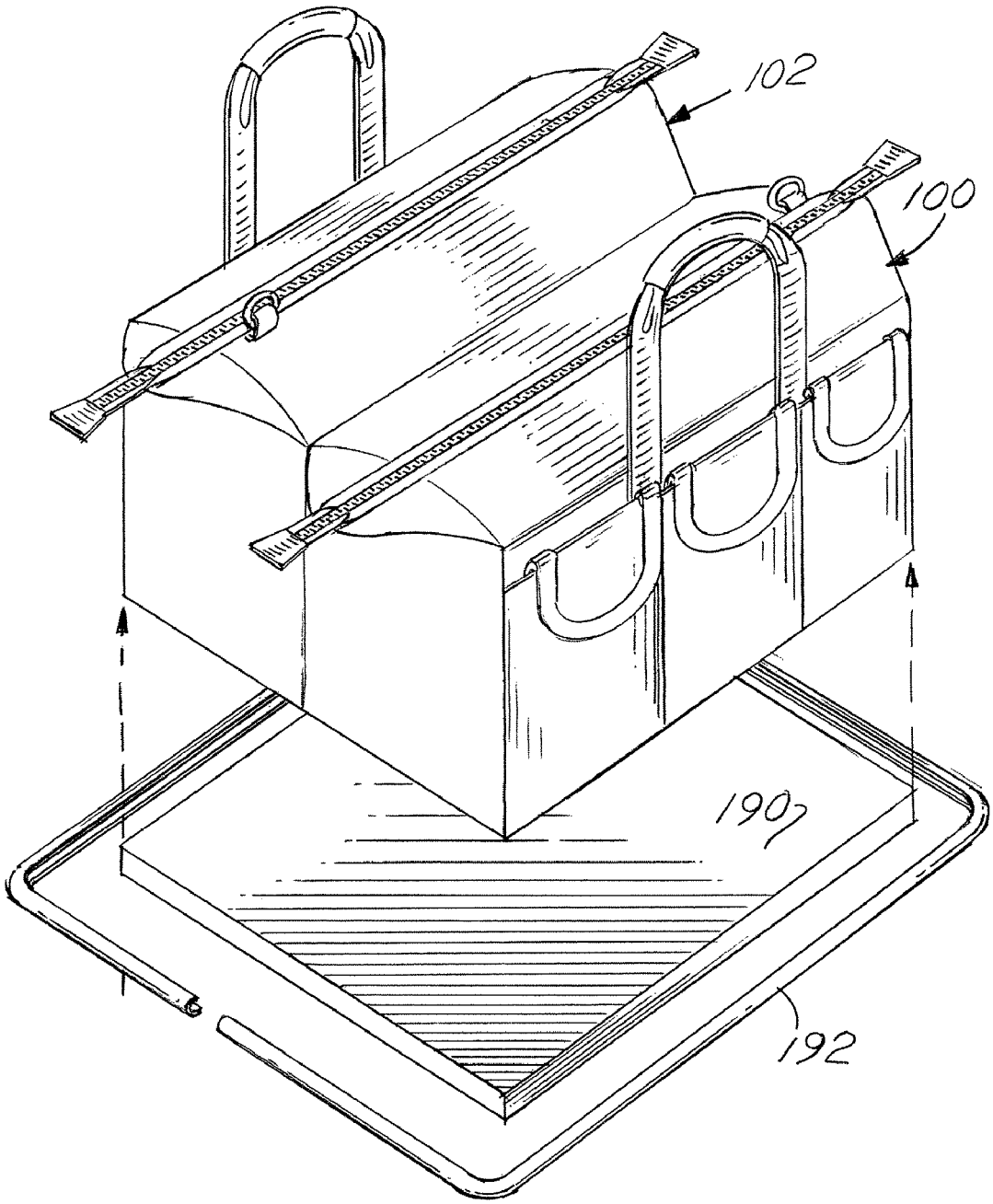
FIG. 20 is an isometric view that illustrates the next step in the process; namely, the attachment of the generally rigid bottom panels to the formed door compartments of the dual bag construction.
Figure 21:
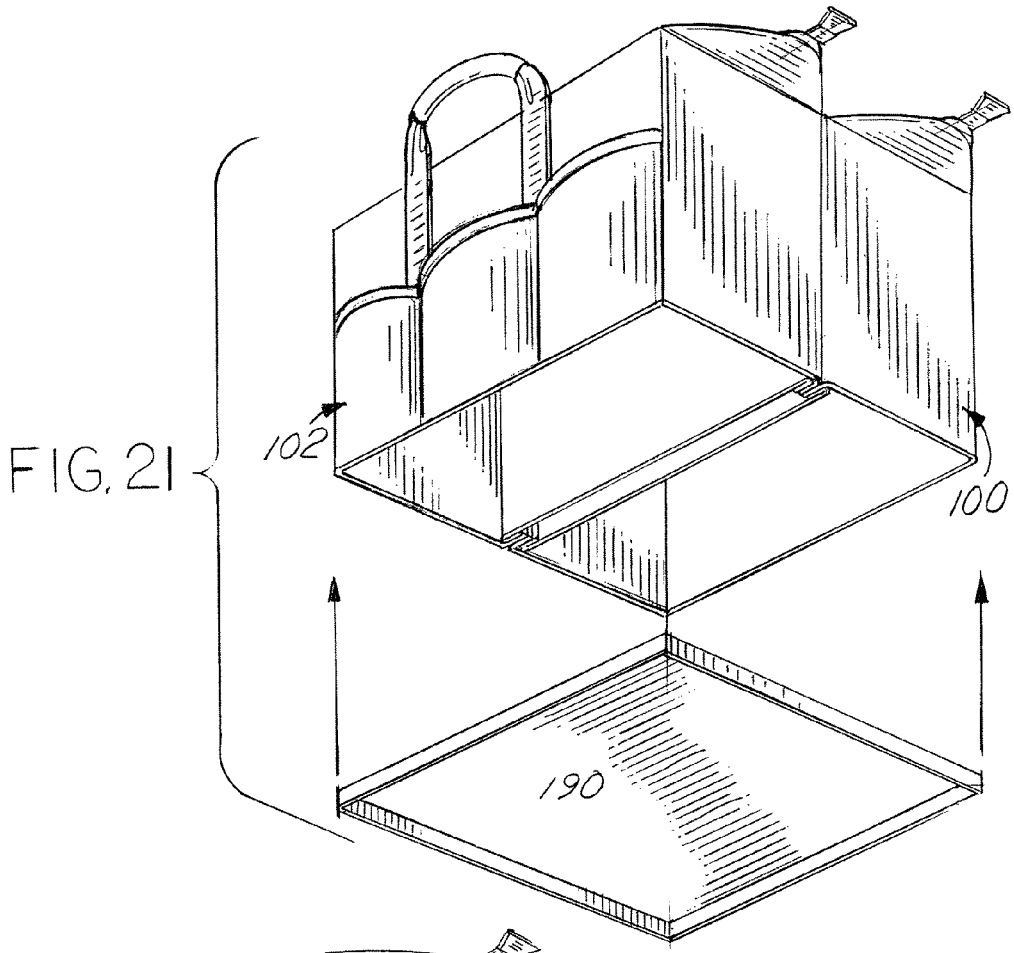
FIG. 21 is an isometric view illustrating a step associated with the embodiment of FIG. 20.

In addition, as shown in FIGS. 17, 18 and 19 a fastening mechanism may be affixed to each of the top edges of the compartments. That is, a binding, such as binding 180, may be attached to the top edge and a zipper mechanism 182 affixed along the top edge and the binding in a manner typically known to those of ordinary skill in the art. Such a zipper mechanism 182 may be attached to each of the compartments, for example, a second zipper mechanism 184 may be attached to the second compartment 102. The resultant construction is depicted in FIG. 19 wherein zipper mechanisms 182 and 184 are provided to close each of the separate compartments 100, 102. It will be noted that junction of the attachment of the margins associated with the inside walls 104; namely, the junction 160 defines a line or limit which enables folding of the inside wall 106 to provide for opening or closure of the bag construction by permitting a segment of the wall to partially form a closure.

Figure 22:
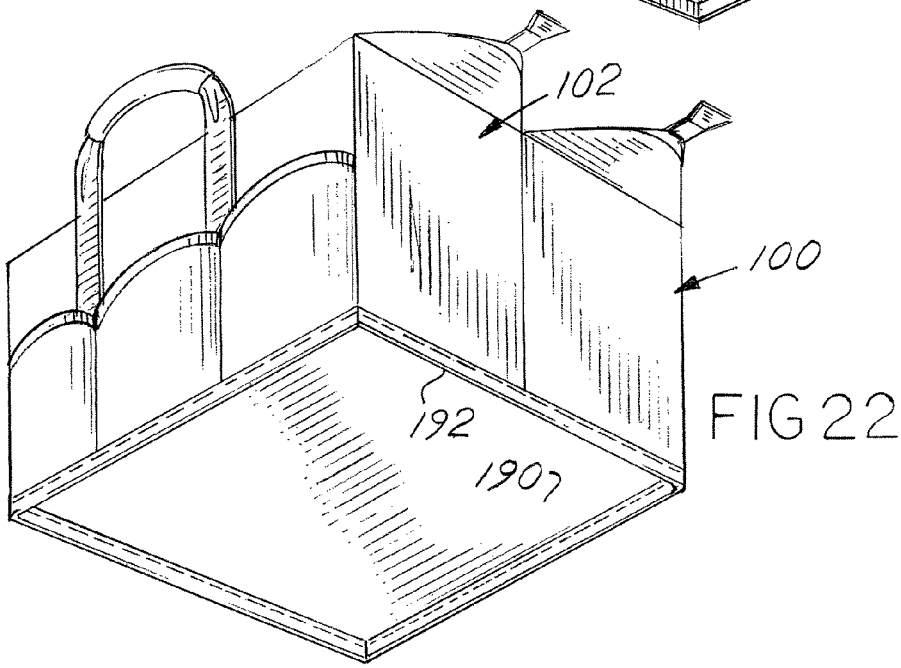
FIG. 22 is an isometric view illustrating the attachment of the bottom panel to the dual compartments forming an embodiment of the invention.

Next in the sequence of formation of the dual opening bag is the attachment of a bottom panel. Typically, the bottom panel comprises a semi-rigid or rigid member, such as a rigid polyethylene board 190 which is attached by means of a binding. Thus, a rigid or semi-rigid board 190 is attached to the side panels by means of a binding 192 around the periphery of the bottom of the first and second compartments 100 and 102 as illustrated, for example, in FIG. 21. FIG. 22 further illustrates the attachment by means of sewing with a binding strip 192 to attach the board or semi-rigid board 190. The resultant bag construction then is depicted in FIG. 23.

FIGS. 24-26 illustrate a further embodiment of the invention. In these figures separate compartments 200 and 202 are separated by an open top middle compartment 206. This is accomplished by sewing in auxiliary or intermediate panels 208 into the opposite ends of the bags or compartments 200, 202. The auxiliary panels or intermediate panels 208 are sewn into the seam of the overlapping margins from the so-called juncture 160 downwardly to the bottom edge of the inside walls 106 during the sewing operation depicted in FIG. 14. Thus, the intermediate panels 208, 210 provide a means to separate the separate bags or compartments while additionally providing an interior open top storage area as illustrated, for example, in FIG. 26. Otherwise, the construction is substantially the same as previously described with respect to FIGS. 7-23.

Variations of the described bag may be provided within in the scope of the invention. The invention therefore is limited only by the following claims and equivalents.

What is claimed is:

1. A generally soft sided bag including at least first and second, side by side, storage compartments comprising, in combination:

a bag interior;

a first compartment in the bag interior in the form of a generally rectangular enclosure fabricated from a pliable material and including first and second generally parallel, spaced end walls of the pliable material, and first and second generally parallel, spaced side walls of the pliable material, one of said side walls comprising an inside wall extending in the bag interior and one of said side walls comprising an outside side wall with the end walls and the outside side wall extending about the bag interior; each of said walls having a bottom and top thereof, said walls being joined together along seams at corners of the enclosure so that the compartment has an open top side and an open bottom side;

said inside wall including lateral side edges and a folded margin at each lateral side edge thereof, said end walls each including a lateral side edge with a margin folded over and joined to one of said margins of said inside wall to form a pair of inside attachment flaps;

a second compartment substantially identical to said first compartment;

the open top side of each compartment defining a perimeter having a closure mechanism;

corresponding inside attachment flaps of each compartment joined together along a section extending from the bottom of the inside wall to a junction below the top thereof to allow an upper portion of each inside wall above the junction thereof to be folded toward an upper portion of the opposite outside side wall to partially cover the respective open top sides of the enclosures; and a bottom wall attached to the side and end walls after the inside attachment flaps are joined together to form the enclosures with the open top and bottom sides thereof with the attached bottom wall closing the open bottom sides of the enclosures.

2. The bag of claim 1 further including disconnected sections of each of the attachment flaps above the respective junctions, and a reinforcement band joining the disconnected sections of the attachment flaps of each compartment.

3. The bag of claim 1 wherein the bottom wall comprises a single rigid or semi-rigid board member.

4. A multi-compartment bag comprising:

a first compartment having opposite flexible side walls and opposite flexible end walls that interconnect the side walls to provide the first compartment with a generally rectangular configuration having an open top and an open bottom thereof;

a second compartment having opposite flexible side walls and opposite flexible end walls that interconnect the side walls to provide the second compartment with a generally rectangular configuration having an open top and an open bottom thereof;

a bag subassembly with one of the side walls of the first compartment arranged adjacent one of the side walls of the second compartment and the other side wall of each compartment being connected together with the adjacent side walls extending therebetween; and a bottom wall connected to the first and second compartment walls to close the open bottoms of the compartments after the subassembly walls have been turned inside out so that the connected other side walls are adjacent each other and extend between the one side wall of the first compartment and the one side wall of the second compartment.

5. The multi-compartment bag of claim 4 wherein the one side wall of the first compartment and the one side wall of the second compartment each have a handle connected thereto so that in the subassembly the handles are between the connected other side walls of the compartments and after the subassembly walls are turned inside out, the adjacent, connected other side walls are between the handles.

6. The multi-compartment bag of claim 4 wherein the side walls each have opposite side edges extending between the top and bottom of the compartments, and the other side walls are connected to each other by seams along their respective side edges that extend from the bottom of the compartments and terminate below the top of the compartments to form upper flap portions of the other side walls for being folded to extend over the open tops of the compartments.

7. The multi-compartment bag of claim 6 wherein the side walls including the upper flap portions have closure mechanisms connected thereto for closing the open tops of the compartments.

8. The multi-compartment bag of claim 4 including intermediate end walls for connecting the other side walls together and cooperating with the other side walls and bottom wall to form an open top, intermediate compartment between the first and second compartments.

9. The multi-compartment bag of claim 4 wherein the bottom wall comprises a single rigid or semi-rigid board member.

* * * * *